US007048155B2

(12) United States Patent
Kuwahara et al.

(10) Patent No.: US 7,048,155 B2
(45) Date of Patent: May 23, 2006

(54) DEPRESSION HEAD FOR PUMP MECHANISM

(75) Inventors: Katsuhito Kuwahara, Tokyo (JP); Hiroshi Mizushima, Tokyo (JP); Takayuki Goto, Tokyo (JP); Yoshiyuki Kakuta, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 10/496,947

(22) PCT Filed: Jun. 28, 2002

(86) PCT No.: PCT/JP02/06585

§ 371 (c)(1),
(2), (4) Date: Jun. 10, 2004

(87) PCT Pub. No.: WO03/047765

PCT Pub. Date: Jun. 12, 2003

(65) Prior Publication Data

US 2005/0006411 A1 Jan. 13, 2005

(30) Foreign Application Priority Data

Nov. 30, 2001 (JP) ..... 2001-366743
May 31, 2002 (JP) ..... 2002-159337

(51) Int. Cl.
*B67D 5/40* (2006.01)

(52) U.S. Cl. ..... 222/321.9; 222/380

(58) Field of Classification Search ..... 222/380, 222/321.9

See application file for complete search history.

(56) References Cited

U.S. PATENT DOCUMENTS 4,182,496 A 1/1980 Burke

FOREIGN PATENT DOCUMENTS

| | | |
|---|---|---|
| JP | U 63-13267 | 1/1988 |
| JP | Y2 63-376 | 1/1988 |
| JP | U 63-20968 | 2/1988 |
| JP | U 64-21763 | 2/1989 |
| JP | A 9-155254 | 6/1997 |
| JP | A 9-225358 | 9/1997 |
| JP | A 11-76881 | 3/1999 |

*Primary Examiner*—Philippe Derakshani
(74) *Attorney, Agent, or Firm*—Oliff & Berridge, PLC

(57) ABSTRACT

A depression head for pump mechanism increasing sealability on the discharge port and enabling favorable shutting of the liquid leakage, said depression head comprising a mounting cylinder assembly 3 having an upright sliding cylinder communicating with the interior of the stem 2; a body 4 adapted to be depressible relative to the mounting cylinder assembly 3 and having an attachment cylinder 11 fitted on the sliding cylinder, a valve chamber disposed above the attachment cylinder and defining a discharge port 12 opened its leading end; a valve member 5 forwardly biased to close the discharge port 19 and defining a passage between the discharge port and a communication port 12 which is also communicating with the interior of a pump cylinder; and a lever member 6 for coupling to the valve member 5 to open the discharge port in response to the depression of the head; wherein a resistive force against the depression of the body with respect to the stem is smaller than a resistive force against the depression of the stem itself.

9 Claims, 10 Drawing Sheets

DEPRESSION HEAD FOR PUMP MECHANISM

TECHNICAL FIELD

The present invention relates to a depression head for pump mechanism, particularly a depression head for attachment on a top of an upwardly-biased stem standing from the pump.

PRIOR ART

One of known depression heads for pump mechanism has a top plate, a vertical cylinder depending from the top wall for connection to the stem, and a lateral cylinder protruding forward from an upper part of the vertical cylinder and defining a discharge port at its front end. After discharging a liquid from the pump, the liquid remained in the lateral cylinder may leak from the discharge port, or clog it by drying. In order to prevent such disadvantages, it is also known to provide a valve inserted in the lateral cylinder and having a valve spindle biased forward with its front end contacting the discharge port, in a manner that the valve is adapted to open only upon depressing the depression head by the mechanism stated below.

U.S. Pat. No. 4,182,496 (which is referred to as a document 1) teaches a valve spindle provided at its base (rear) portion with a cylindrical piston for slidably fitting into a base part of the lateral cylinder, such that when the depression head is depressed, the valve spindle is retreated by pressurization of the liquid in the lateral cylinder.

Japanese Patent Laid-Open No. 9 (1997)-225358 (which is referred to as a document 2) teaches a head adapted for up-and-down movement relative to the stem, said head having a plate-like spring depending from its top plate and terminating at a lower end in contact with the top of the stem, and a valve spindle having a rear end coupled to an intermediate portion of the plate-like spring such that the spring is forced to bend rearward upon the depression of the head to retreat the valve spindle.

Japanese Utility Model Laid-open No. 63-13267 (which is referred to as a document 3) and Japanese Utility Model Laid-open No. 63-20968 (which is referred to as a document 4) teach a device comprising a slant sliding surface defined on a top of the stem and a depression head adapted for up-and-down movement relative to the stem, said depression head having a lateral valve spindle defining an slidable engagement portion at a lower edge of its portion such as rear end portion of the valve spindle, said slidable engagement portion being engageable with the slant sliding surface, such that depression force to the depression head is transformed to a lateral force by which the valve member is forced back and forth.

Japanese Patent Laid Open No. 9(1997)-155254 (which is referred to as a document 5), teaches a device shown in FIG. 12 (*a*) having a vertical cylinder (101) and a swayable piece (103) which is formed by a portion of the rear wall of the vertical cylinder, by cutting an inverted U shaped slit (102) in the rear wall, such that the piece may sway about its lower end. The swayable piece has a thickened upper half through which a rear portion of the valve spindle (106) is penetrated and fixed thereto. A slant surface (104) is formed at an inside of the lower half of the swayable piece, such that the slant surface makes a contact with an annular projection 105 of the pump upon depression of the depressible head to force the swayable piece to tilt as shown in FIG. 12(*b*) so as to retard the valve spindle.

Japanese Utility Model Publication 63(1988)-376 (which is referred to as a document 6), teaches as shown in FIG. 13 a depression head having a top wall (111) which is separated from a reminder thereof and pivoted at its back. A leg portion (112) is depending from the back portion of the top wall (111) and coupled to the rear portion of the valve spindle (113), such that when the front portion of the top wall (111) is depressed against an elastic force of a spring (114), the valve spindle is retreated by leverage action.

SUMMARY OF INVENTION

Referring to the prior art, the action of the valve spindle according to the document 1 may be impaired by hardening and subsequent adhesion of the liquid to the inside of the lateral cylinder and the surface of the spindle, which may be occurred in accordance with the kind of liquid.

In the document 2, the plate-like spring may lose elasticity due to its fatigue in repetition of bending and recovering, and this makes worse the shutting of the liquid leakage.

In the documents 3 and 4, smooth up-and-down movement of the depression is likely to be hindered by torque caused as a counteraction by the collide of the valve spindle against the slant surface.

In the device depicted in the document 5, the manipulation of the depression head is susceptible to considerable drag, since it requires depression force to overcome not only resistance to the normal depression of the head for actuation of the pump but also resistance to back and forth movement of the valve spindle against biasing force. Moreover, the device is applicable only to the type of the pump having the annular projection, so that wide utility cannot be expected.

Furthermore, the depression head according to the document 6 has the top wall defined as a push button, such that an aesthetic feature of the pump as a product is limited. Especially, the push button may be an impediment to form the pump into a simple appearance which is favorable to a container for cosmetic good. And also, for manipulating the push button, it requires to position a user's finger on the front wall portion of push button correctly. Moreover, the spring is formed as a separate part from the lever member having the top wall and foot portion, so that there is room for reducing the number of parts of the product.

First purpose of the present invention is to propose a depression head for pump mechanism, having a lever member for proceeding and retreating the valve member to open and close the discharge port with its leading end, in order to provide a preferable seal between the discharge port and the valve member, and also, an easy depression of the head feasible by a light push for facilitating a stable discharge of the liquid when the discharge port is closed. And moreover, such depression head is durable for a long period of use.

Second purpose of the present invention is to dispose the lever member between the base (rear) portion of the valve member and a top plate of an mounting cylinder assembly mounted on a top of the stem, such that the depression head is applicable to any kind of pump, actuable by pushing anywhere within a top wall of the body for achieving easy manipulation, and also presents a simple appearance of its body for attachment on a mounting cylinder assembly.

Third purpose of the present invention is to give a spring function to the valve member itself, so as to reduce the number of the parts and manufacturing cost of the depression head for the pump mechanism.

Fourth purpose of the present invention is to provide the depression head with anti-rotation mechanism between its body and the mounting cylinder assembly fitted on the top of the stem to prevent the body from being rickety against the stem so as to enable its smooth up-and-down movement relative to the same.

For achieving the first and second purposes, the present invention provides a depression head for attachment on a pump having a depressible and upwardly urged stem, said depression head comprising;

a mounting cylinder assembly having a top plate, a mounting cylinder depending from an underside of the top plate for fitting on an upper end of the stem, and a sliding cylinder extending upwardly from the top plate and communicating with the stem, a body capable of depressing with respect to the mounting cylinder assembly, said body including a cylinder for slidable and depressible attachment on an outside of the sliding cylinder, a valve chamber disposed above the attachment cylinder and having a discharge port defined at its leading end, said valve chamber communicating with the attachment cylinder through a communication port, a generally rod-like valve member for insertion into the valve chamber and being forwardly urged to close the discharge port and having a sealing portion (peripheral sealing portion) making a liquid tight contact with an inner surface (sealed surface) of a rear portion of the valve member, such that a liquid passage from the communication port to the discharge port is defined between the valve member and the valve chamber forwardly of the sealing portion, a lever member having an upper portion coupled to a rear end portion of the valve member, and a lower end portion contacting to an upper side of the top plate 8 for coacting (engaging) therewith, and said lever member being pivoted swayably capable of pulling the valve member rearward, upon depression of the body with respect to the mounting cylinder assembly, characterized in that a resistive force against the depression of the body with respect to the stem is smaller than a resistive force against the depression of the stem itself.

For achieving the third purpose, the present invention proposes the depression head set forth in the first and second purpose, characterized in that the valve member is made of flexible and elastic material, and in that the valve member is provided at its periphery With a flange-like elastic wall from which the sealing portion is extending to and fitting in a rearward end portion of the valve chamber, such that the valve member is urged forwardly by a biasing force of the elastic wall to close the discharge port.

For achieving the fourth purpose, the present invention proposes to provide the depression head as depicted with respect to the foregoing purposes, with an anti-rotation mechanism formed on the mounting cylinder assembly and the body so as to allow up-down movement and check rotation of the mounting cylinder assembly with respect to the body.

The mounting cylinder assembly may have a pair of engagement plates extending upwardly and downwardly from on both side of the top plate such that the anti-rotation mechanism is defined between the outside of the respective engagement plate and an inside of the peripheral wall of the body, and in that the body has a lateral cylinder formed within the valve member with its front end opened through a front portion of the peripheral wall, while an attachment cylinder for attachment to the mounting cylinder assembly is depending from the lateral cylinder into a space between the pair of engagement plates.

The other purpose will be apparent from the following description.

BEST MODE FOR CARRYING OUT THE INVENTION

Figure 1:
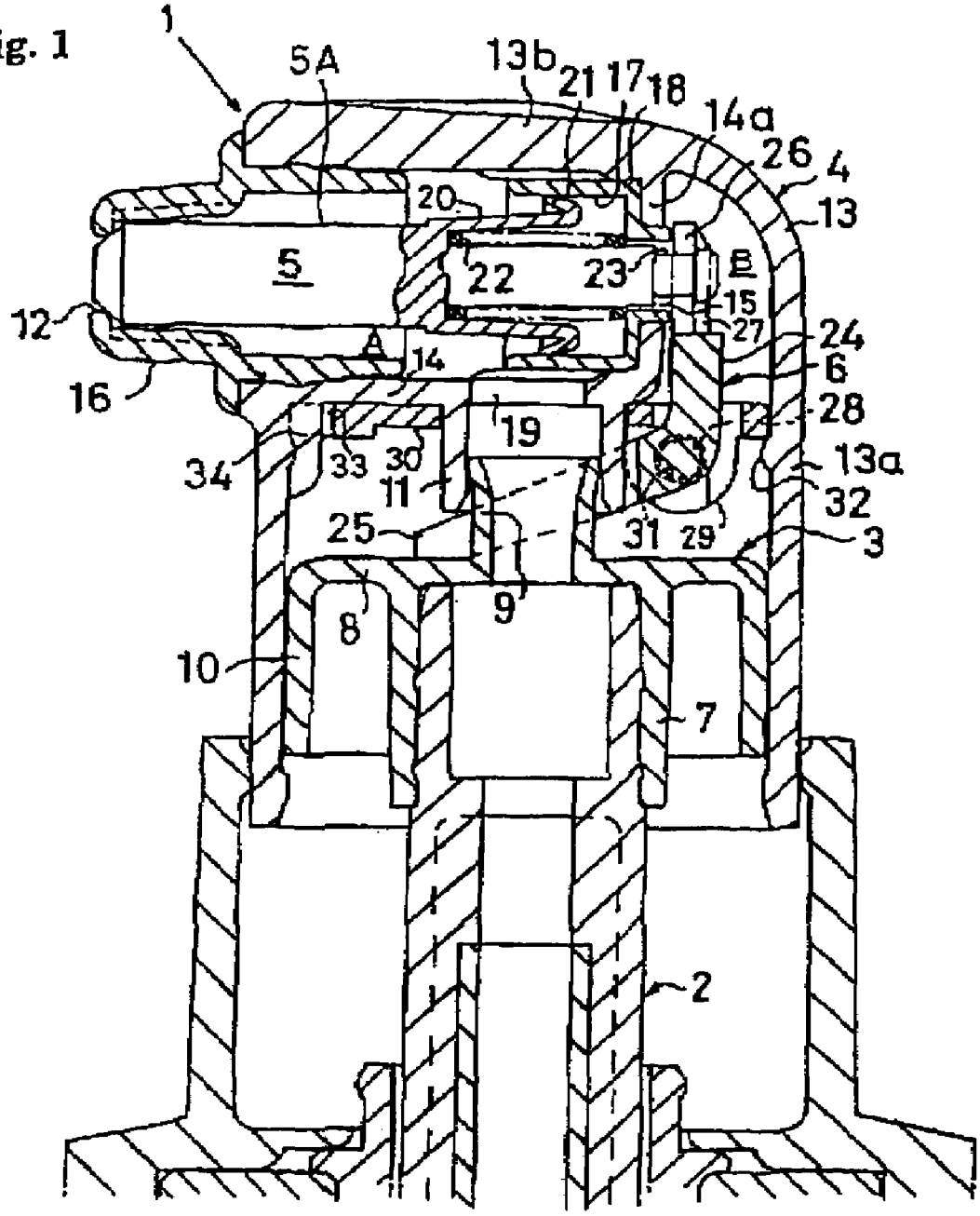
FIG. 1 is a vertical section of a depression head according to a first embodiment of the present invention.

Hereinafter, the modes of the present invention are explained according to the drawing. In the explanation, the words "front and rear" and "left and right" are used to show relative locational between each parts thereof.

A depression head 1 according to the present invention is adapted for use to fit on the top of the stem 2 of a pump. The pump is adapted to discharge a liquid therein through the stem by the depression thereof. The pump may be an ordinary type with a pump cylinder and a piston, or that of an aerosol type.

In the present invention, the depression head 1 comprises a mounting cylinder assembly 3, a body 4, a valve member 5, and a lever member 6.

The mounting cylinder assembly 3 has a mounting cylinder 7 for fitting on the top end of the stem 2, which is depending from the underside of a top plate 8, and a sliding cylinder 9 standing from a center portion of the top plate 8 and communicating with the interior of the stem 2. A guiding cylinder 10 is depending from the periphery of the top plate 8.

The body 4 is linked to the stem 2 by means of the mounting cylinder assembly 3 in a depressible manner. More concretely, the body 4 has an attachment cylinder 11 which is fitted on an outside of the sliding cylinder 9 slidably and descendably, and a valve chamber (A) disposed above the attachment cylinder 11 and opening a discharge port 12 at its front end, such that the body is depressible with respect to the mounting cylinder assembly 3. In the preferable shown embodiment, the body 4 further comprises a bottom-opened cylinder-shaped cover member 13 having a peripheral wall 13*a*, from the top end of which the top wall 13*b* is extended. Within the cover member 13, the valve chamber (A) is provided at the underside of the front portion of the top wall 13*b*, spaced away from the rear portion of the peripheral wall 13*a* to form an interval (B) therebetween. The attachment cylinder 11 is depending from the underside of the valve chamber (A).

The valve chamber (A) has a lateral cylinder 14 which is formed at and integrally with the front portion of the top wall 13*b* on its underside, such that the upper wall of the lateral cylinder is merged into the top wall and possessed by the lateral cylinder and the top wall in common. The lateral cylinder 14 has the leading end opened trough the front portion of the peripheral wall 13*a*, and a rear wall 14*a* at a center of which port hole 15 is formed. The valve chamber (A) also have a nozzle cylinder 16 which is fitted in the leading end portion and defining a discharge port 12 at its leading end, and a cylinder member 18 which is fitted into the rear portion of the lateral cylinder 14 and defining a sealed cylinder portion 17 for slidable engagement with a portion of sliding cylinder later-described. And also, the valve chamber (A) is provided with a communication port 19 for communicating with the attachment cylinder 11.

The valve member 5 has a laterally elongated, valve spindle 5A having a sealing portion 21 at its periphery of its rear portion for slidably fitting into a sealed surface defined by the inside of the rear portion of the valve chamber (A). The valve spindle 5A is urged and biased forward to close the discharge port 12 with its leading end, and provided with a rear end portion protruding from the port hole 15. The valve member 5 may only be a generally rod-like shape elongated along the axis of the lateral cylinder, and its structure may vary accordingly. Moreover, the sealing portion 21 have any shape capable of sealing the whole of the sealed surface liquid-tightly, such as annular, cylindrical, or plate-like shape corresponding complementary to the shape of the section of the valve chamber (A).

In a preferred shown embodiment, the skirt-like portion 20 is extending rearward from a longitudinally middle portion of the valve spindle 5A, while the sealing portion 21 is turned back from a rear end of the skirt-like portion 20 and configured into an inverted skirt-like shape, such that the outer periphery of the sealing portion 21 is fitted slidably and liquid-tightly into the inside of the sealed cylinder portion 17. Due to this structure, the valve member 5 may have favorable flexibility which guarantees that the stable back-and-forth movement of the slidable sealing portion is not hindered by the possible deformation or torsion of the same in vertical direction. This feature provides a favorable tight seal between the sealing portion 21 and sealed cylinder 17 by flexing adaptably to its non-axial movement. Although the valve member 5A of the present invention is susceptible to minute up-and-down excursion (or displacement) when it is pulled backwardly by a lever member later-described, a desirable sealability is guaranteed due to the feature. And moreover, the valve member 5 defines a liquid passage between the inside of the valve chamber (A) and the outside of the valve spindle forward of the sealing portion 21 to provide communication from the communication port 19 to the discharge port 12. A coil spring 22 for forwardly urging the valve member 5 is interposed between the front side of the rear wall of the cylinder member 18 and a base of the skirt-like portion 20 defining a branchpoint. Moreover, the rear end portion of the valve spindle 5A is protruding through the port hole 15, while a annular recess 23 for engagement with the lever member 6 is formed around the rear end portion of the valve spindle 5A protruding through the port hole 15.

The lever member 6 has an upper end portion coupled to the rear end portion of the valve member 5, and a lower end portion contacting with and engageably resting on the upper surface of the top plate 8, such that the lever member 6 sways to pull the valve member 5 backward upon the depression of the body 4 with respect to the mounting cylinder assembly 3.

In the shown embodiment, the lever member 6 comprises a vertical plate 24 having an upper end portion coupled to the rear end portion of the valve member 5, and a forked slant plate 25 descending forwardly from the lower end of the vertical plate 24. The forked slate plate 25 is defined by two branches, the lower ends of which are resting on the upper surface of the top plate 8, oppositely from the sliding cylinder 9 (on its left and right in the shown embodiment). In this embodiment, the vertical plate 24 is provided at a center of its upper end portion with a notch 26 for engagement with the annular recess 23 of the valve member 5, such that the coupling of the lever member 6 to the valve member 5 is formed by the engagement. More concretely, the vertical plate 24 is provided at a rear side of its upper end portion with a recess 27 having a rectangular shape as seen from the back, and the notch 26 is disposed to provide communication between the recess 27 and the notch 26.

Figure 4:
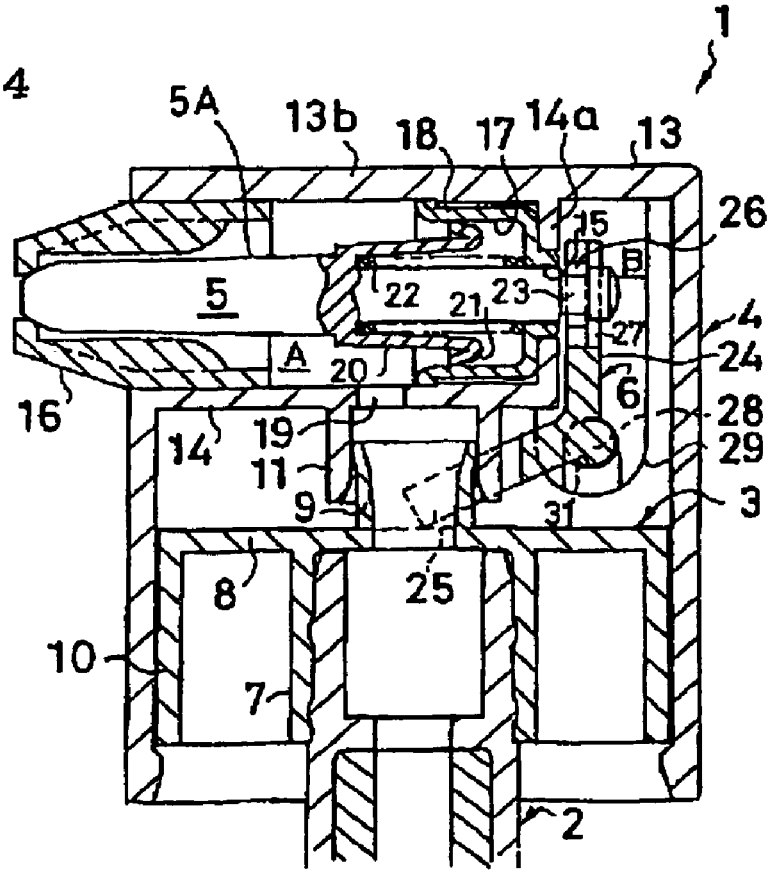
FIG. 4 is a vertical section of a depression head according to a second embodiment of the present invention.

The lever member 6 has a bent portion defined between the vertical plate 24 and the slant plate 25, and a pair of pivot axle portions 28 are protruding from both sides (left and right sides in the shown embodiment) of the bent portion for rotationally fitting into a pair of corresponding axle receptors 29. In the shown embodiment, an attachment plate 30 is fitted just under the lateral cylinder 14, and the axle receptors 29 are depending from the underside of a rear portion of the attachment plate 30, and spaced a distance from each other. Each said axle receptor is provided at its inside with an axle fixture recess 31 and a tapered recess for introduction of the axle into the axle fixture recess extending from the lower end of the axle receptor and having a greater width at its lower end. The attachment plate 30 also has a fitting hole for fitting with the attachment cylinder 11, and a through hole through which the vertical plate 24 of the lever member 6 is penetrating swayably. In this embodiment, moreover, the body 4 has an engagement ridge 32 formed circumferentially on the inside of its peripheral wall 13*a*, such that the periphery of the attachment plate 30 is adapted to be forced past and engageably resting on the engagement ridge 32. And also, a notch 33 is formed at one side of the periphery of the attachment plate 30, while an engagement rib 34 for engagement with the notch 33 is provided at a corresponding position on the inside of the peripheral wall 13*a* so as to prevent the rotation of the attachment plate 11 with respect to the body 4. In this embodiment, the axle receptor 29 and body 4 are formed as separate parts, but they may be formed integrally as shown in FIG. 4. The axle receptor may be formed in whatever structure desired, only if it can provide a pivot support of the lever member 6 in a swayable manner.

The depression head 1 is so constructed that the upper part of the vertical plate 24 defining a coupling portion is normally biased forwardly by the valve member 5 which is also forwardly biased by the coil spring 22, and when the body 4 is depressed, the top plate 8 of the mounting cylinder assembly 3 pushes up the slant plate 25 to rotate the lever member 6, such that the valve member 5 is pulled backward against the forwardly biasing force of the coil spring 22.

In the depression head described above, the present invention proposes that a resistive force against the depression of the body 4 with respect to the stem 2 is smaller than a resistive force against the depression of the stem 2. A principle method to achieve this feature is that the elastic force of an elastic member for forwardly biasing the valve member 5 is selected to be smaller than that of an elastic member for upwardly biasing the stem of the pump. In an actual depression head, the elastic force of the two member may be selected in consideration of a frictional resistance between the pump cylinder and the cylindrical piston, and a frictional resistance to the movement of lever member when it is swayed.

In this embodiment, the aforementioned parts are made of synthetic resin unless described otherwise, but they may be made of the synthetic resin and other suitable material such as metal or elastomer in accordance with situations.

Figure 2:
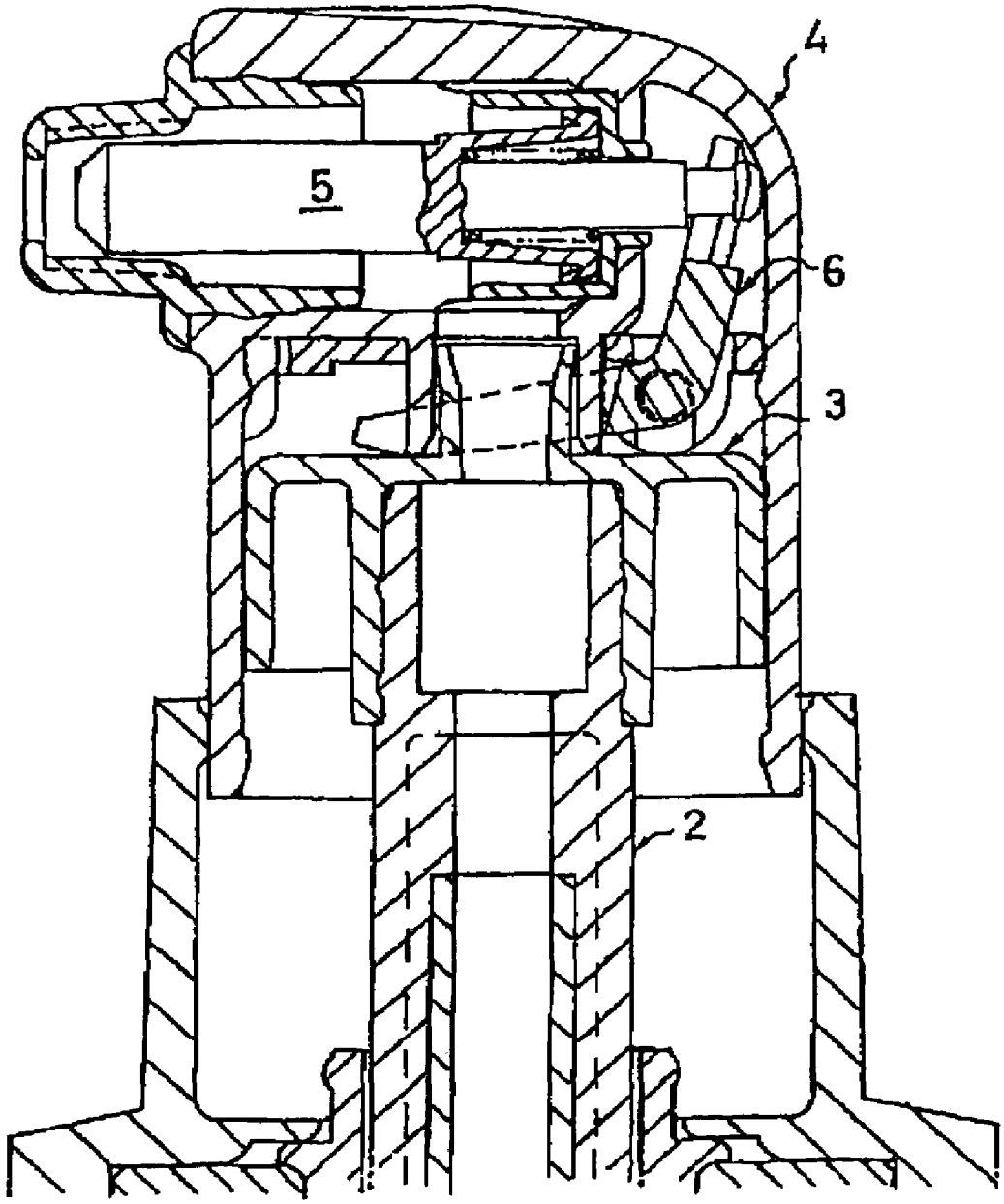
FIG. 2 is a vertical section of the same head in a depressed state.
Figure 3:
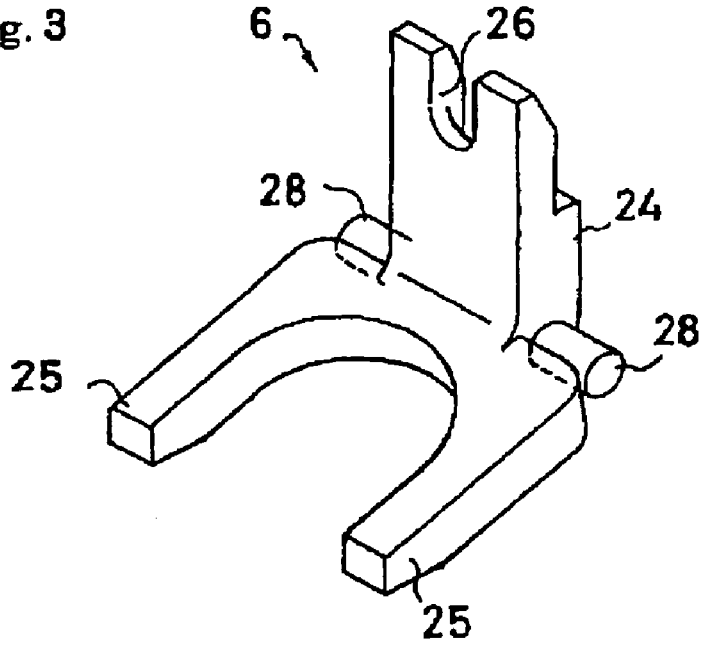
FIG. 3 is a perspective view of a level member in the same head.

According to the above-mentioned construction of the depression head 1, when the cover member 13 is depressed from a state shown in FIG. 1, the body 4 moves downward with respect to the mounting cylinder assembly 3, because the stem 2 is not descendable initially as shown in FIG. 2 due to the resistive force against the depression of the stem 2 itself, which is larger than the resistive force of the body 4 against the stem 2. As the result, the lower end of the lever member 6 is pushed up by the top plate 8 of the mounting cylinder assembly 3 to rotate the lever member 6 about the pivot axle portion 28, such that the upper end of the lever member 6 is turned rearward to cause backward movement of the valve member 5 against the elastic force of the coil spring 22 so as to open the discharge port 12. Thereafter, the descent of the stem 2 occurs to cause the liquid in the pump to flow through the stem 2, the attachment cylinder 11, the communication port 19, and the liquid passage in the valve chamber (A), thereby to discharge it from the discharge port 12.

When releasing the depression of the cover member 13, the depression head 1 initially ascends by the upwardly biasing force of the stem 2. Usually, the release of the depression is executed by removing user's hand depressing the upper surface of the head outwardly (i.e. upwardly), however, in the initial state, the ascent of the stem 2 is swifter than the motion of the user's hand, such that the ascent is executed before the hand actually releases the head, while the discharge port 12 being still open. Accordingly, the inside of the valve chamber (A) is in a negative pressure at this state. After that, there arises a room for actually releasing the head from the hand, such that the valve member 5 moves forward by the elastic force of the coil spring 22 to close the discharge port 12. At the same time, the lever member 6 pushes up the body 4 relative to the mounting cylinder assembly 3, and the depression head returns to its original state.

Hereinafter, other embodiments of the invention is explained according to the drawing. The explanation on the structure substantially identical to the first embodiment may be omitted using the same numeral instead.

FIG. 4 shows a second embodiment of the present invention, in which the axle receptors 29 are integrally formed with the body 4. In stead of the axle receptors 29 and attachment plate 30 in the first embodiment, the receptors 29 in this embodiment, are formed into a vertically elongated shape and depending from the rear portion of the top plate 13*b* of the body 4 spaced apart from each other. The axle receptor 29 has the axle fixture recess 31 for rotational engagement with pivot axle portion 28.

Figure 5:
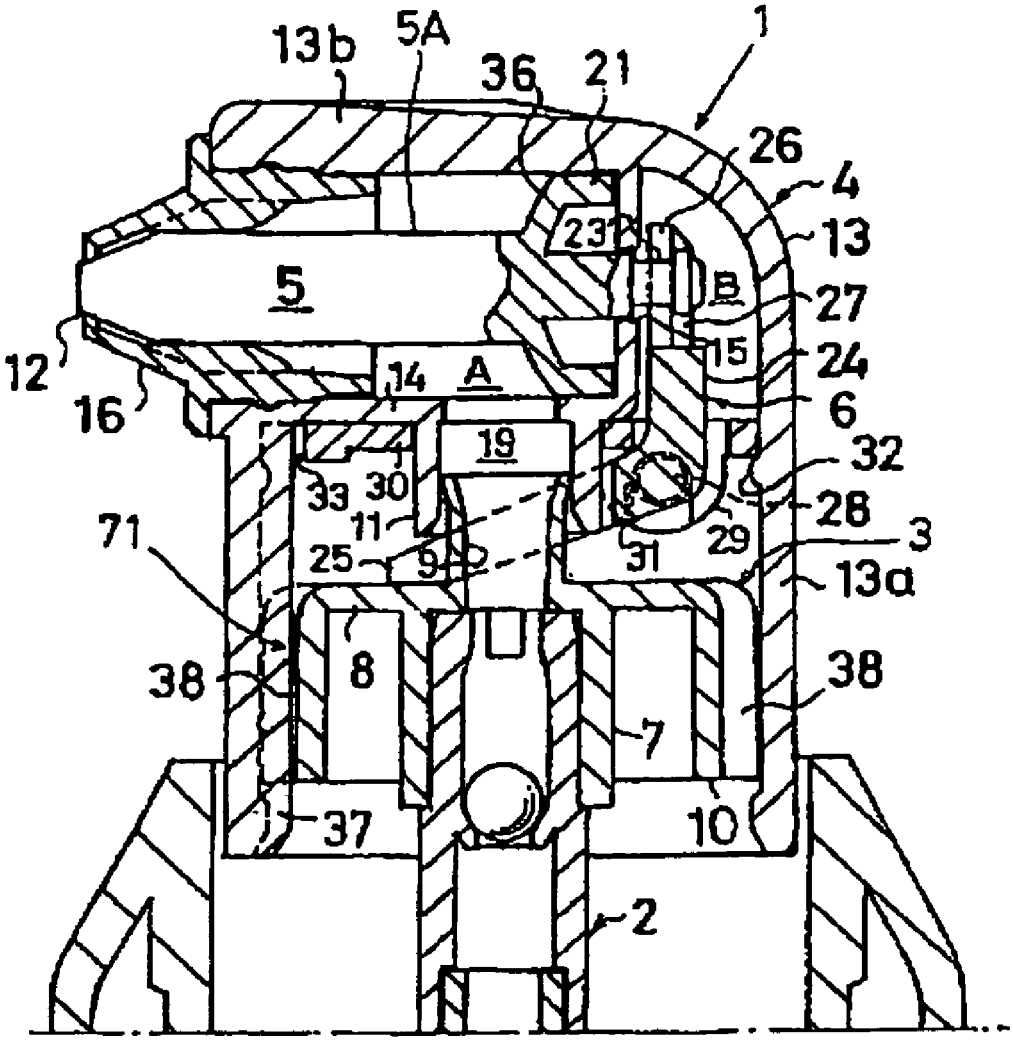
FIG. 5 is a vertical section of a depression head according to a third embodiment of the present invention.

FIG. 5 shows a third embodiment of the present invention, showing modification of the valve member 5. The valve member 5 as a whole is made of flexible and elastic material such as elastomer. The sealing portion 21 is formed into a cylindrical portion for fitting into the rear end portion of the inside of the valve chamber (A) liquid-tightly. The sealing portion is extending from the flange-like elastic wall 36 which is formed on the periphery of the valve member 5, such that the discharge port 12 is closed by means of the top end of valve member 5 by the elastic force of the flanged-like elastic wall 36. In the drawn embodiment, the flange-like elastic wall 36 is formed slant radial rearwardly.

In this embodiment too, a resistive force against the depression of the body 4 with respect to the stem 2 is smaller than a resistive force against the depression of the stem 2 itself in the depression head described above. To achieve this feature, the elastic force of the flange-like elastic member 36 for forwardly biasing the valve member 5 is selected to be smaller than that of an elastic member for upwardly biasing the stem of the pump. In an actual depression head, the elasticity of the two portions may be selected in consideration of a frictional resistance between the sliding cylinder and the cylinder member, and a frictional resistance to the movement of lever member when it is swayed.

In this embodiment, the valve chamber (A) is formed by the lateral cylinder 14 and nozzle cylinder 16, omitting the cylinder member 18 in the first embodiment. The sealing portion 21 defined by the cylindrical portion is tightly fitted into and engaged with the rear portion of the inside of the lateral cylinder 14. Moreover, the coil spring in the first embodiment is omitted. Instead of it, the forwardly urging force to the valve member 5 is exerted by the flange-like elastic wall 36. In the depression head according to this embodiment, the number of parts is decreased, such that the manufacturing cost is reduced and the fabrication is simplified.

In this embodiment, moreover, there is provided between the mounting cylinder assembly 3 and the body 4, an anti-rotation mechanism 71 for allowing an up-and-down movement but preventing the rotation of the mounting cylinder assembly with respect to the body 4.

In the shown embodiment, the anti-rotation mechanism 71 is formed by a vertical ridge 37 formed vertically on the inside of the peripheral wall 13*a* of the body 4, and a vertical groove 38 formed on the guiding cylinder 10 of the mounting cylinder assembly 3 for providing vertically slidable engagement with the vertical ridge 37. These vertical ridge 37 and vertical groove 38 may be provided one or plurality of locations. In the shown embodiment, the vertical grooves are provided in three, i.e., front, left and right positions, and the vertical ridges are provided in four, i.e., the front and rear, left and right positions. Due to the anti-rotation mechanism, the depression head 1 does not rotates with respect to the mounting cylinder assembly 3, the lever member 6 is free from twisting and other unfavorable force, even though it is coupled to the upper surface of the mounting cylinder assembly 3, thereby enabling its smooth action. The anti-rotation mechanism 71 of this embodiment is applicable to the first and later-described embodiments.

In the depression head 1 of the structure mentioned above, when the cover member 13 is depressed from the state shown in FIG. 5, the body 4 moves downward with respect to the mounting cylinder assembly 3, and the upper end of the lever member 6 is turned rearward to cause backward movement of the valve member 5 against the elastic force of the flange-like elastic wall 36 so as to open the discharge port 12, from which the liquid is discharged.

After releasing the depression of the cover member 13, the depression head 1 ascends with the discharge port 12 being still open. When the depression head is actually released from the head, the valve member 5 moves forward to close the discharge port 12 by the elastic reinforcing force of the flange-like elastic wall 36. And at the same time, the body 4 is pushed upwardly with respect to the mounting cylinder assembly 3 by the lever member 6 to recover to the original state.

Figure 6:
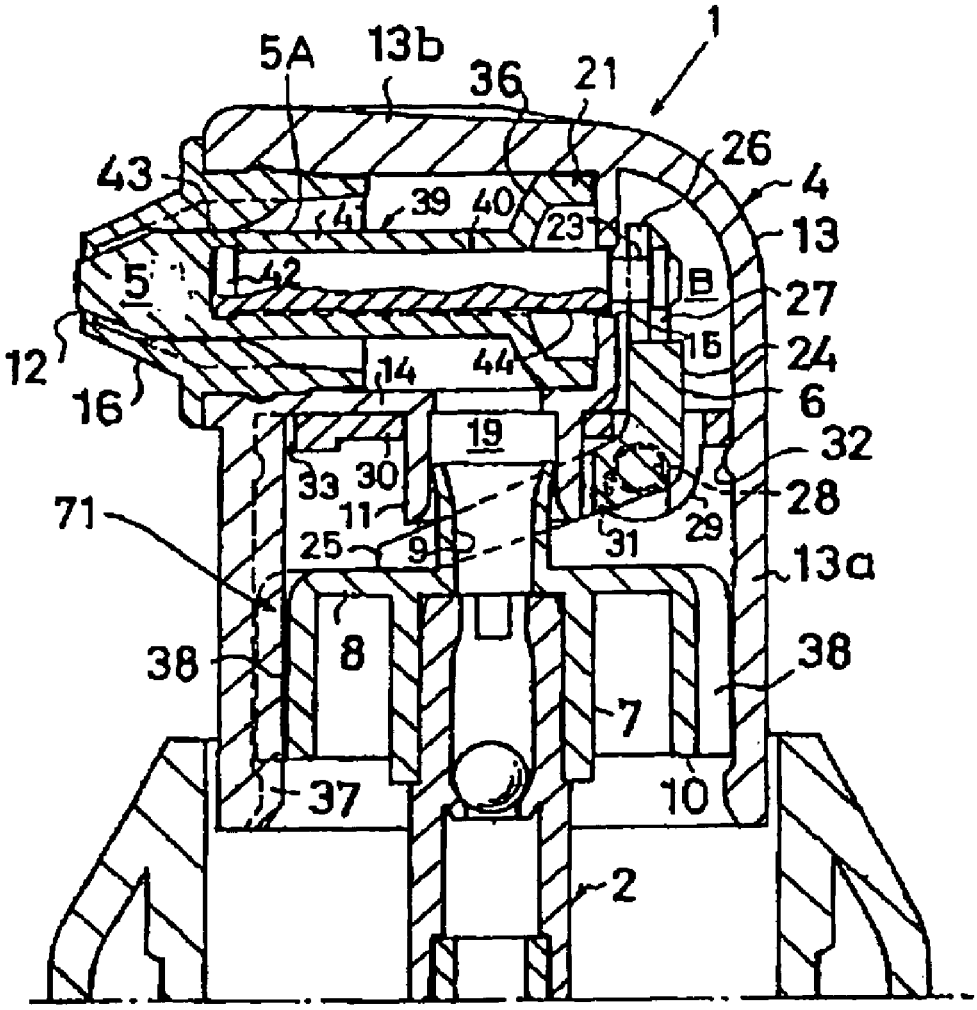
FIG. 6 is a vertical section of a depression head according to a fourth embodiment of the present invention.

FIG. 6 shows a fourth embodiment of the present invention, which relates to another modification of the valve member 5. The valve member 5 is formed by an elastic member 39 made of flexible and elastic material material such as elastomer, and a core member 40 made of stiff material such as synthetic resin.

The elastic member 39 has a cylinder member 41 with a closed leading end and having at its periphery a flange-like elastic wall 36, from which the sealing portion 21 is protruding. The sealing portion is defined by a cylindrical portion for fitting liquid-tightly into the rear end portion of the inside of the valve, chamber (A). The core member 40 has a front portion fitted and fixed within the cylinder member 41 and a rear end portion protruding rearward. The valve member is adapted to close the discharge port 12 by the forwardly biasing force of the flange-like elastic wall 36, and also defines a liquid passage between the discharge port 12 and a communication port 19 which is also communicating with the attachment cylinder 11, as it does in the previous embodiment.

For fixing the core member 40 within the cylinder member 41, any method can be taken if it can sufficiently prevent the unintentional slipping away of the core member 40 from cylinder member 41. Example of preferable methods are, adhesion using adhesive agent, welding, and the provision of mechanical engagement means. In the shown embodiment, complementary projected and recessed engagement means are provided on the inside of the cylinder member 41 and the outside of the core member 40. More concretely, a ridge 42 is formed on the outer circumference of the leading end of the core member 40, and a groove 43 for engagement with the ridge 42 is formed on the inner circumference of the cylinder portion 41. Insertion of the core member 40 into the cylinder member 41 may be executed forcibly utilizing the elasticity of the elastic member 39, but may be performed by the insertion molding. The core member 40 may be provided with a groove 44 along the axis thereof. Such groove functions as an air displacement passage for facilitating the forcible insertion of the core member 40 in a former case, but also prevents mutual rotation between the core member 40 and the cylinder member 41 in the latter case, since the resin of the cylinder member 41 is filled within the groove 44.

In this embodiment, the valve chamber (A) is formed by the lateral cylinder 14 and nozzle cylinder 16, omitting the cylinder member 18 in the first embodiment, as it is in the third embodiment, such that the sealing portion 21 defined by the cylindrical portion is fitted liquid-tightly into the rear end portion of the inside of the lateral cylinder. The coil spring is also omitted. Moreover, the anti-rotation mechanism 71 is provided.

This embodiment contributes to the reduction in the number of parts and manufacturing cost of the depression head, as the third embodiment does. In addition to this, a coupling portion of valve member for coupling with the lever member 6 has resistance has a rigidity sufficient for preventing deformation and guarantee smooth reciprocation.

Figure 7:
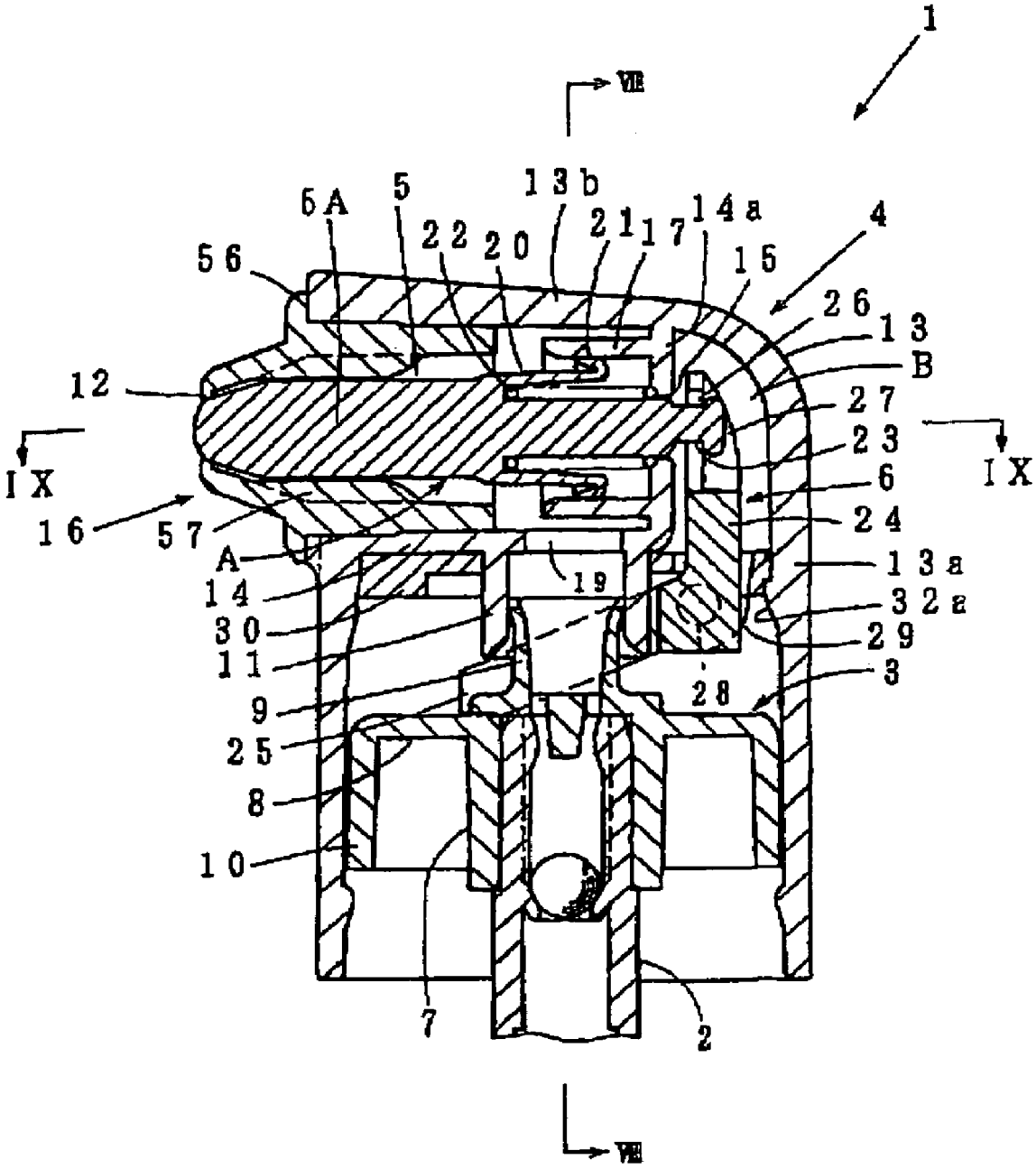
FIG. 7 is a vertical section of a depression head according to a fifth embodiment of the present invention.
Figure 8:
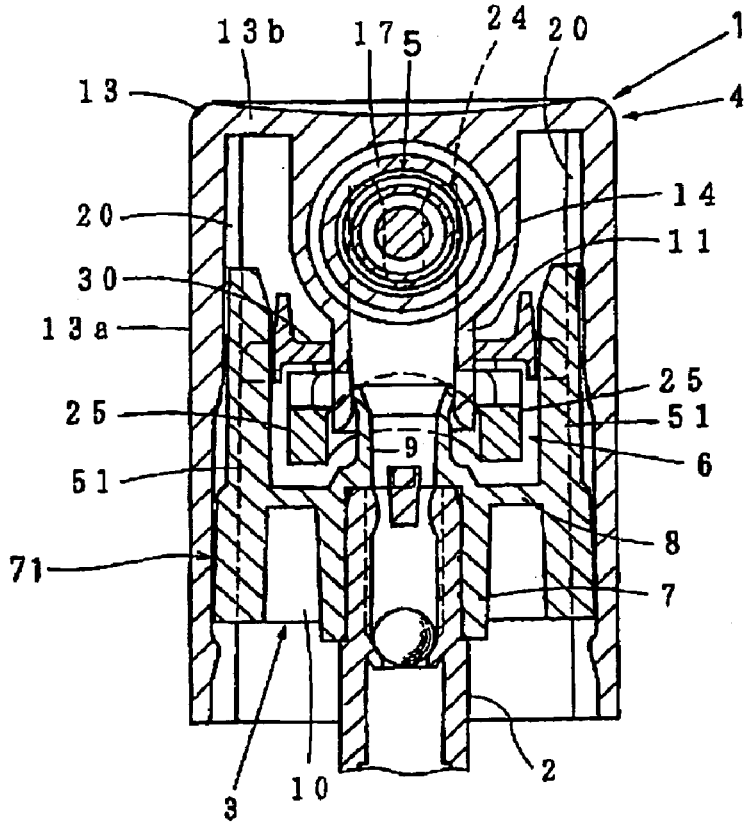
FIG. 8 is a vertical section of the same head taken along VIII—VIII line in FIG. 7.
Figure 9:
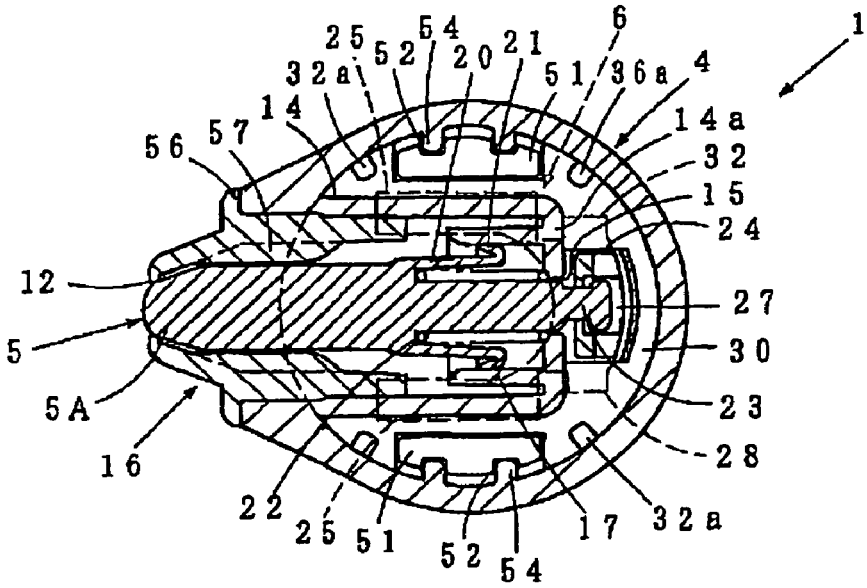
FIG. 9 is a cross section of the same head along IX—IX line therein.

FIGS. 7 to 9 show the fifth embodiment of the present invention. This embodiment chiefly provides an engagement plate with anti-rotation mechanism, and a variation of the sealed cylinder and the nozzle cylinder according to the first embodiment. The engagement plate is provided in the mounting cylinder assembly for guiding the body 4 of the depression head.

The mounting cylinder assembly 3 has, as shown in FIG. 8, a mounting cylinder 7 for fitting on the stem 2, which is depending from a top plate 8, and a sliding cylinder 9 standing from a center portion of the top plate 8 and communicating with the interior of the stem 2. A pair of engagement plates 51 are standing from the left and right sides of the top plate 8, and also extending downwardly therefrom. In a preferred embodiment, a lower part of the engagement plate 51 below the top plate 8 is formed as a portion of the guiding cylinder 10. A pair of engagement groove 52 are provided at the outside of each engagement plate 51.

The body 4 comprises, as shown in FIG. 7, a cover member 13 with a peripheral wall 13*a* and a top wall 13*b*, and a lateral cylinder 14 having a front end opened through the front portion of the peripheral wall 13*a* and extending rearward therefrom, while the upper wall of the lateral cylinder 14 merging into the top wall 13*b* and possessed by the lateral cylinder and the cover member in common. And as shown in FIG. 9, the lateral cylinder is spaced a distance away from the left, right and rear portions of the peripheral wall 13*a*, such that the pair of engagement plates 51 and the lever member 6 are housed in the space therebetween.

Moreover, the anti-rotation mechanism 71 is formed between the peripheral wall 13*a* and the engagement plates 51 by engaging the inner surface of the both sides of the peripheral wall with the outer surface of the engagement plates 51 irrotationally and vertically slidably. Any engagement means may be used, if it meets with the above-mentioned condition. However, in this embodiment, a pair of engagement ridges 54 are provided respectively at the left and right portions of the peripheral wall 13*a* for engagement with the engagement grooves 52 on the outside of the engagement plate 51.

In the above mentioned structure, the engagement means (engagement ridges and engagement grooves in the shown embodiment) may have a engagement width sufficient to provide a positive engagement, since there are provided the spaces on both sides of the lateral cylinder 14, in which the engagement plates 51 for engagement with the peripheral wall 13*a* are extending vertically. In addition to this, the engagement plates 51 are engaged therewith in irrotational and vertically slidable manner. This guarantees the stable up-and-down movement of the discharge head with respect to the mounting cylinder assembly 3, thereby preventing the discharge head 1 from being rickety and shaky. As a result, smooth action of the pump cylinder and the cylinder piston therein is guaranteed, and so is the action of the pump.

Furthermore, in the to this embodiment, the body 4 is formed with the lateral cylinder 14 having a rear wall 14*a* which is provided at its center with port hole 15, and a sealed cylinder 17 protruding forward from the front side of the rear wall 14*a* around the port hole 15. Due to this structure, it is not necessary to form the cylinder member 18 as a separate part from the sealed cylinder 17, as it is in the first embodiment, thereby reducing the number of parts and manufacturing cost, and facilitating the fabrication of the depression head.

The depression head according to this embodiment also has a nozzle cylinder 16 for insertion into the lateral cylinder 14 and opening a discharge port 12 at its leading end. The nozzle cylinder 16 has a rear portion which is inserted into the front portion of the lateral cylinder 14 liquid-tightly, and a front portion tapering and reducing in diameter toward its front end at which the discharge port 12 is opened. An annular protrusion 56 for abutment against the front surface of the body 4 is extending from the outer periphery of the nozzle cylinder 16, and includes a plurality of ribs 57 formed on its inside and spaced apart each other circumferentially.

Figure 10:
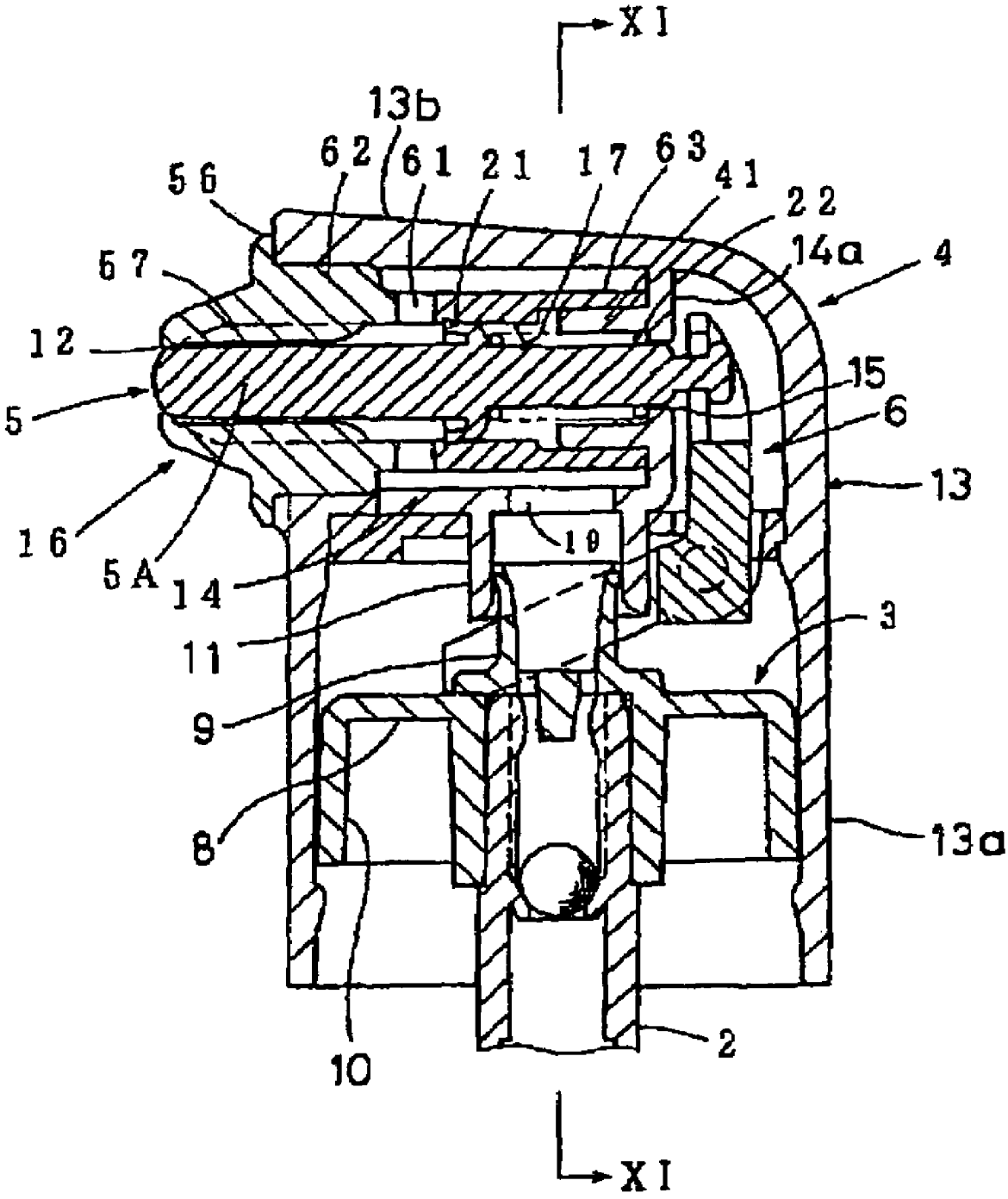
FIG. 10 is a vertical section of a depression head according to a sixth embodiment of the present invention.
Figure 11:
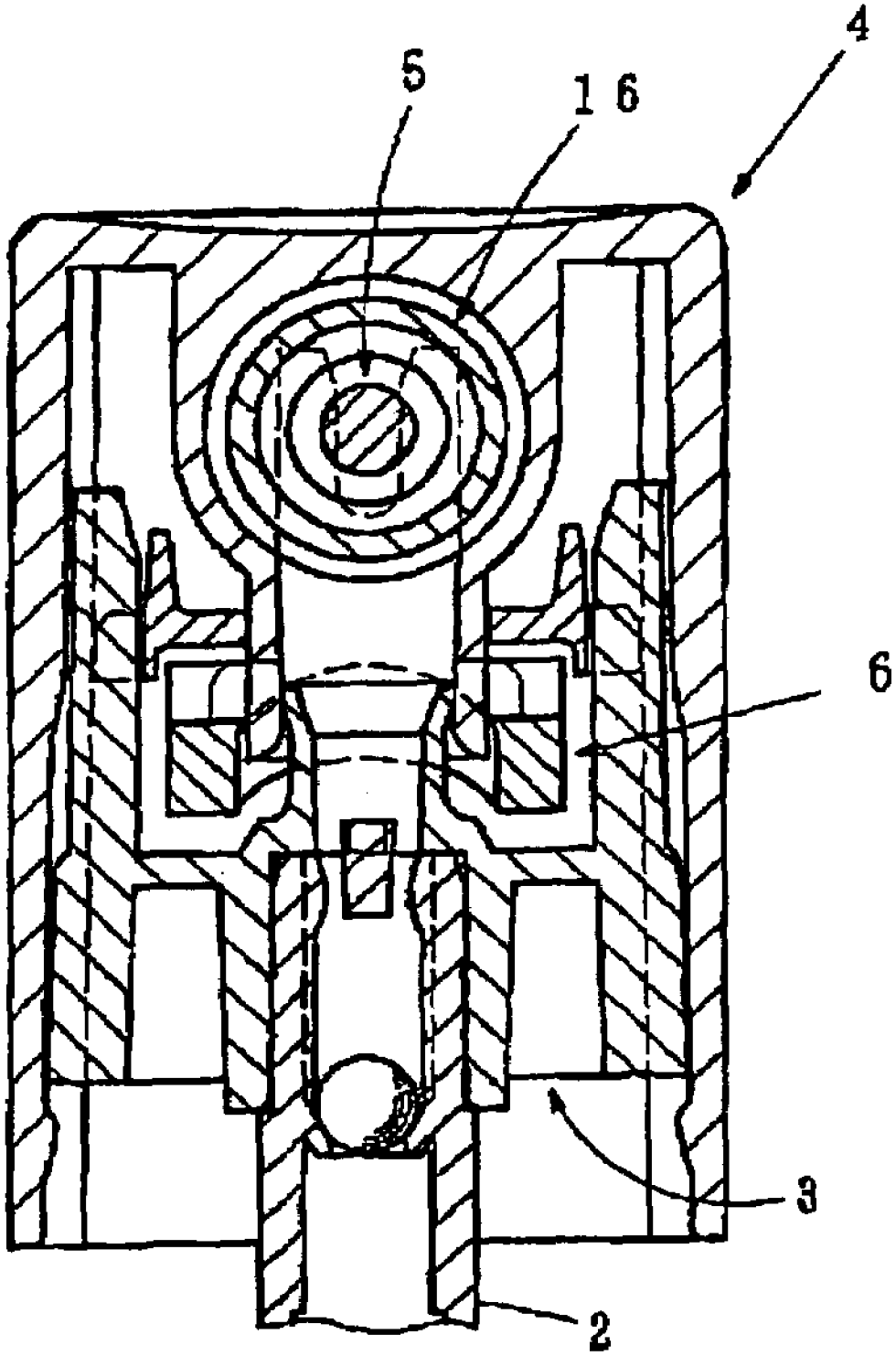
FIG. 11 is a vertical section of the same head taken along XI—XI line in FIG. 10.
Figure 12:
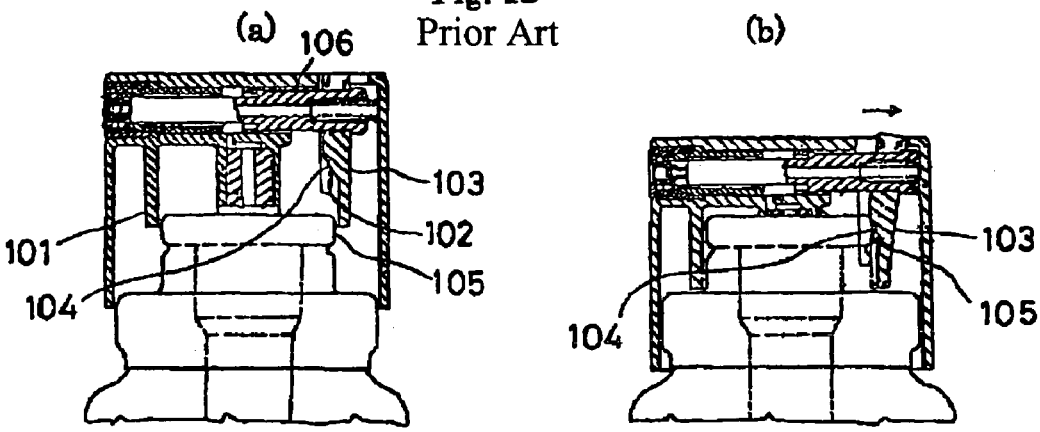
Fig. 12 Prior Art
FIG. 12 shows a prior art depression head, wherein FIG. 12(*a*) is a vertical section of the head, and FIG. 12(*b*) is an explanation view of a state of use thereof.
Figure 13:
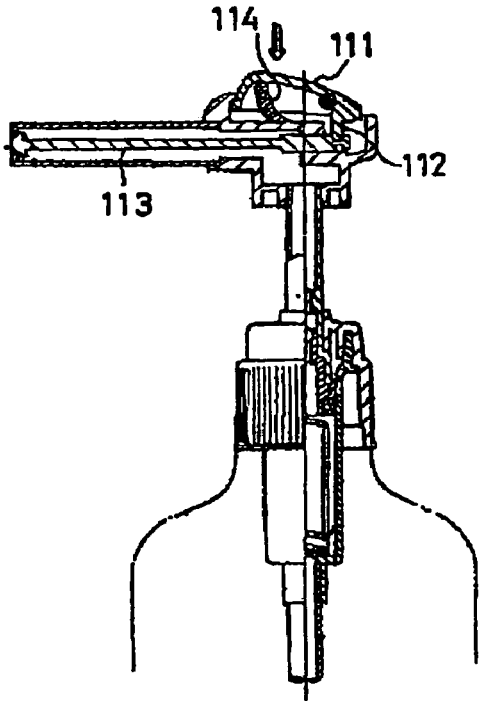
Fig. 13 Prior Art
FIG. 13 is a vertical section of another prior art depression head.

FIGS. 10 and 11 shows a six embodiment of the present invention, in which the sealed cylinder portion of the fifth embodiment is formed integrally with the nozzle cylinder. The nozzle cylinder 16 is inserted into the lateral cylinder 14 and has a rear portion formed into a sealed cylinder portion 17, while opening a discharge port 12 at its leading end. A plurality of communication holes 61 are provided in a portion of the nozzle cylinder 16 forward of the sealed cylinder portion 17 and spaced apart each other circumferentially.

In the shown embodiment, the nozzle cylinder 16 has a front portion formed into a larger outer diameter portion 62 and a rear portion formed into a smaller outer-diameter portion 63. The larger outer-diameter portion 62 is fitted liquid-tightly into the inside of the leading end portion of the lateral cylinder 14 and includes a leading end portion tapering and reducing in diameter as it extends forward, and opening a discharge port 12 at its front end. On the other hand, the body 4 has the lateral cylinder 14 with a rear wall 14*a* from which a cylindrical, sealing portion 21 for providing a tight fit between its outside and the smaller outer diameter portion 63, such that the nozzle cylinder 16 is fixed to the body 4. Moreover, the ribs 57 and annular protrusion 56 described in relation with the FIG. 7 is also provided in this embodiment.

The valve member 5 may be formed into rod-like shape. And moreover, an inverted skirt-like sealing portion 21 is protruding forward from a longitudinally middle portion of the valve member 5 for fitting into the sealed cylinder 17 liquid-tightly and slidably, and biased forwardly by means of a coil spring 22 interposed between the base of the sealing portion 21 and the rear wall 14*a* of the lateral cylinder. Similar to the previous embodiment, the interior of the attachment cylinder 11 is communicating with the communication port 19, and the communication port is communicating with the discharge port 12, through the communication holes 61 through an interval between the lateral cylinder 14 and the nozzle cylinder 16.

The invention claimed is:

1. A depression head for attachment on a pump having a depressible and upwardly urged stem, said depression head comprising;

a mounting cylinder assembly having a top plate, a mounting cylinder depending from an underside of the top plate for fitting on an upper end of the stem, and a sliding cylinder extending upwardly from the top plate and communicating with the stem, a body capable of depressing with respect to the mounting cylinder assembly, said body including an attachment cylinder for slidable and depressible fitting on an outside of the sliding cylinder, a valve chamber disposed above the attachment cylinder and having a discharge port defined at its leading end, said valve chamber communicating with the attachment cylinder through a communication port, a valve member for insertion into the valve chamber and being forwardly urged to close the discharge port and having a sealing portion making a liquid tight contact with a rear portion of the valve chamber, such that a liquid passage from the communication port to the discharge port is defined between the valve member and the valve chamber forwardly of the sealing portion, a lever member having an upper portion coupled to a rear end portion of the valve member, and a lower end portion contacting to an upper side of the top plate for coacting therewith, said lever member being pivoted swayably capable of pulling the valve member rearward, upon depression of the body with respect to the mounting cylinder assembly, characterized in that a resistive force against the depression of the body with respect to the stem is smaller than a resistive force against the depression of the stem itself.

2. The depression head set forth in claim 1, characterized in that the valve member has a skirt like portion protruding rearward from its periphery, and in that the sealing portion is turned back from a rear end of the skirt like portion and configured into an inverted skirt-like shape, such that the sealing portion is slidably engaged within a rear portion of the valve chamber.

3. The depression head set forth in claim 1, characterized in that the valve member is made of flexible and elastic material, and in that the valve member is provided at its periphery with a flange-like elastic wall from which the sealing portion is extending to and fitting within a rearward end portion of the valve chamber, such that the valve member is urged forwardly by a biasing force of the elastic wall to close the discharge port.

4. The depression head set forth in claim 1, characterized in that the valve member comprises; an elastic member made of flexible and elastic material and defining a cylinder member with a closed front end, said cylinder member being provided at its periphery with a flange-like elastic wall from which the sealing portion is extending to and fitting in a rearward end portion of the valve chamber liquid-tightly;

a core member made of stiff material having a front portion for fitting in and fixing to the cylinder member, and a rear end portion protruding rearwardly;

such that the valve member is urged forwardly by a biasing force of the elastic wall to close the discharge port.

5. The depression head set forth in claim 1, characterized in that the body comprises a peripheral wall, and a lateral cylinder defining at its inside the valve chamber with a front end being opened through a front portion of the peripheral wall, and in that the valve chamber is formed with a rear portion of the lateral cylinder, a rear wall for closure of a rear end of the lateral cylinder, and a nozzle cylinder which is fitted into a front portion of the lateral cylinder so as to define the discharge port at its front end, and in that the body also comprises a sealed cylinder protruding forward from a front side of the rear wall for slidably fitting the sealing portion therein, while the rear wall has within the sealed cylinder port hole through which the rear end portion of the valve member is protruding for coupling to the upper end portion of the lever member.

6. The depression head set forth in claim 1, characterized in that the body comprises a peripheral wall, and a lateral cylinder defining at its inside the valve chamber with a front end being opened through a front portion of the peripheral wall, and in that the valve chamber is formed with a rear portion of the lateral cylinder, a rear wall for closure of a rear end of the lateral cylinder, and a nozzle cylinder which is fitted into a front portion of the lateral cylinder so as to define the discharge port at its front end, and in that the nozzle cylinder has a rear portion forming the sealed cylinder for slidably receiving the sealing portion, and a communication hole defined forwardly of the sealed cylinder, and in that the rear wall is provided with a port hole through which a rear end portion of the valve member is protruding for coupling to an upper end portion of the lever member.

7. The depression head set forth in claim 5, further comprising an anti-rotation mechanism formed on the mounting cylinder assembly and the body so as to allow up-down movement and check rotation of the mounting cylinder with respect to the body.

8. The depression head set forth in claim 7, characterized in that the mounting cylinder assembly has a pair of engagement plates extending upwardly and downwardly from on both side of the top plate such that the anti-rotation mechanism is defined between the outside of the respective engagement plate and an inside of the peripheral wall of the body, and in that an attachment cylinder for attachment to the mounting cylinder assembly is depending from the lateral cylinder into a space between the pair of engagement plates.

9. The depression head set forth in claim 6, further comprising an anti-rotation mechanism formed on the mounting cylinder assembly and the body so as to allow up-down movement and check rotation of the mounting cylinder with respect to the body.

* * * * *